US011008771B2

(12) United States Patent
Xu

(10) Patent No.: US 11,008,771 B2
(45) Date of Patent: May 18, 2021

(54) IN-WATER SUCTION CLEANER

(71) Applicant: Qiang Xu, Montclair, CA (US)

(72) Inventor: Qiang Xu, Montclair, CA (US)

( * ) Notice: Subject to any disclaimer, the term of this patent is extended or adjusted under 35 U.S.C. 154(b) by 240 days.

(21) Appl. No.: 16/129,795

(22) Filed: Sep. 13, 2018

(65) Prior Publication Data

US 2020/0087940 A1 Mar. 19, 2020

(51) Int. Cl.
*E04H 4/16* (2006.01)

(52) U.S. Cl.
CPC ..... *E04H 4/16* (2013.01)

(58) Field of Classification Search
CPC ..... E04H 4/16; E04H 4/1618; E04H 4/1636
See application file for complete search history.

(56) References Cited

U.S. PATENT DOCUMENTS 4,240,174 A * 12/1980 Thiem ..... A47L 9/02 15/1.7
5,454,129 A * 10/1995 Kell ..... E04H 4/1654 15/1.7
8,281,441 B1 * 10/2012 Erlich ..... E04H 4/1618 15/1.7
10,174,516 B2 * 1/2019 D'Aguanno ..... B01D 35/02
2005/0247613 A1 * 11/2005 Bishop ..... E04H 4/1636 210/167.16
2006/0265820 A1 * 11/2006 Erlich ..... E04H 4/1636 15/1.7
2020/0102765 A1 * 4/2020 Kippes ..... B08B 1/002

* cited by examiner

*Primary Examiner* — David Redding
(74) *Attorney, Agent, or Firm* — Raymond Y. Chan; David and Raymond Patent Firm

(57) ABSTRACT

An in-water suction cleaner includes a portable housing for disposing at water of a pool or tank, a motorized unit supported in the portable housing for vacuuming a suction cavity of the portable housing to suck the water in the suction cavity out of the portable housing through a fluid outlet of the portable housing so as to create a suction at a fluid inlet of the portable housing, a manual scrubbing arrangement detachably coupled at the fluid inlet of the portable housing for scrubbing pool or tank surfaces and for sucking the water into the suction cavity at the same time, and a filtering element replaceably disposed in the suction cavity for filtering the water from the fluid inlet to the fluid outlet through the suction cavity so as to ensure the water after filtered being discharged back to the pool or tank via the fluid outlet.

13 Claims, 4 Drawing Sheets

IN-WATER SUCTION CLEANER

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to a cleaning device, and more particularly to an in-water suction cleaner, which can effectively sucking dirt fluid into the housing to filter out debris and dirt from the fluid and to drain out clean fluid after it is filtered.

Description of Related Arts

Swimming pools, water tanks, or ponds require regular maintenances such as filtration and water treatment. Beyond these maintenances, wall surfaces, i.e. sidewalls and bottom walls, of the pool or tank should be scrubbed regularly. There are generally two types of pool cleaners for surface scrubbing. The type is the autonomous robotic cleaner that it can crawl along the wall surfaces by itself. However, such autonomous robotic cleaner has several drawbacks of limiting the battery power to limit the continuous use of the autonomous robotic cleaner, taking long time to clean the entire pool, and not fitting for irregularly shaped pools. Another type is the manual cleaner which comprises a motor housed in a housing, an elongated handle, and a scrubbing head provided at one end of the handle. Therefore, the operator is able to hold the handle and manually scrub the pool surface by the scrubbing head in order to suck the water into the handle. However, such manual cleaner also has several drawbacks. The suction power is relatively weak when debris and dirt are collected in the housing. Since the housing is not waterproof, it must be stayed away from the pool to prevent the housing being fallen into the pool. In other words, the portability of the handle will be limited to restrict the scrubbing movement of the scrubbing head. As a result, the operator must move the housing from places to places in order to clean different sports of the pool surfaces. More important, the pool water is sucked into the housing and is then drain out from the housing. Therefore, it is a waste of water to clean the pool surfaces. In other words, the pool is needed to refill the water after every scrubbing operation of the manual cleaner.

SUMMARY OF THE PRESENT INVENTION

The invention is advantageous in that it provides an in-water suction cleaner, which can effectively sucking dirt fluid into the portable housing to filter out debris and dirt from the fluid and to drain out clean fluid after it is filtered.

Another advantage of the invention is to provide an in-water suction cleaner, wherein the suction power at the scrubbing head is substantially increased by creating a negative pressure in the portable housing so as to prevent any suction power lost at the scrubbing head.

Another advantage of the invention is to provide an in-water suction cleaner, wherein the portable housing is disposed in the water to enhance the portability of the portable housing during the operation.

Another advantage of the invention is to provide an in-water suction cleaner, wherein the filtering element is interchangeable and washable for filtering different fluids with debris and dirt. In other words, the in-water suction cleaner can be used in a variety of applications by simply coupling the filtering element in the portable housing, such as coupling a low fluid permeable filter for pond cleaning, or coupling a high fluid permeable filter for swimming pool cleaning.

Another advantage of the invention is to provide an in-water suction cleaner, wherein the debris and dirt will be initially deposited and precipitated at the bottom of the unfiltered cavity before the water is filtered to enhance the filtering efficiency of the filtering element.

Another advantage of the invention is to an in-water suction cleaner, which is simple and easy to operate, wherein an inexperienced person is able to operate the in-water suction cleaner to clean the pool surfaces.

Another advantage of the invention is to an in-water suction cleaner, wherein no expensive or complicated structure is required to employ in the present invention in order to achieve the above mentioned objects. Therefore, the present invention successfully provides an economic and efficient solution for providing an effective tool to clean the pool surface without wasting water.

Additional advantages and features of the invention will become apparent from the description which follows, and may be realized by means of the instrumentalities and combinations particular point out in the appended claims.

According to the present invention, the foregoing and other objects and advantages are attained by an in-water suction cleaner for cleaning a pool or tank, comprising:

a portable housing for disposing in water of the pool or tank, wherein the portable housing has a suction cavity for filling the water therein, a fluid inlet for guiding the water to enter into the suction cavity, and a fluid outlet for discharging the water in the suction cavity;

a motorized unit supported in the portable housing for vacuuming the suction cavity to suck the water in the suction cavity out of the portable housing through the fluid outlet so as to create a suction at the fluid inlet;

a manual scrubbing arrangement detachably coupled at the fluid inlet of the portable housing for scrubbing pool or tank surfaces and for sucking the water into the suction cavity at the same time; and a filtering element replaceably disposed in the suction cavity for filtering the water from the fluid inlet to the fluid outlet through the suction cavity so as to ensure the water after filtered being discharged back to the pool or tank via the fluid outlet.

In accordance with another aspect of the invention, the present invention comprises a method of operating an in-water suction cleaner for cleaning a pool or tank, comprising the following steps.

(1) Submerge a portable housing into water to fill the water into a suction cavity of the portable housing via a fluid inlet thereof.

(2) Detachably couple a manual scrubbing arrangement at the fluid inlet of the portable housing.

(3) Power on a motorized unit, which is supported in the portable housing, for vacuuming the suction cavity to suck the water in the suction cavity out of the portable housing through a fluid outlet thereof so as to create a suction at the fluid inlet.

(4) Filter the water from the fluid inlet to the fluid outlet through the suction cavity via a filtering element replaceably disposed in the suction cavity.

(5) Discharge the water back to the pool or tank via the fluid outlet after the water is filtered.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Figure 1:
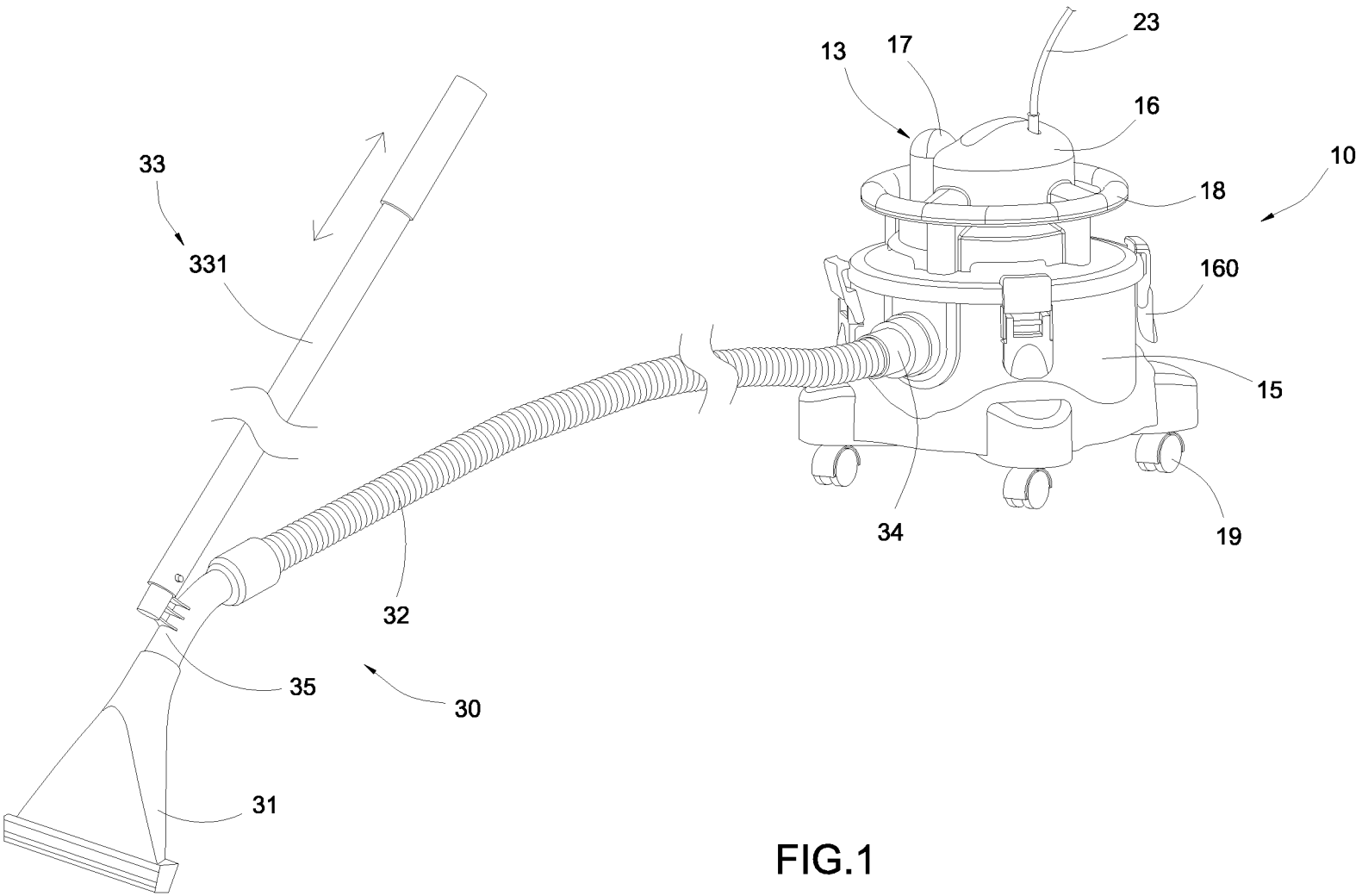
FIG. 1 is a perspective view of an in-water suction cleaner according to a preferred embodiment of the present invention.
Figure 2:
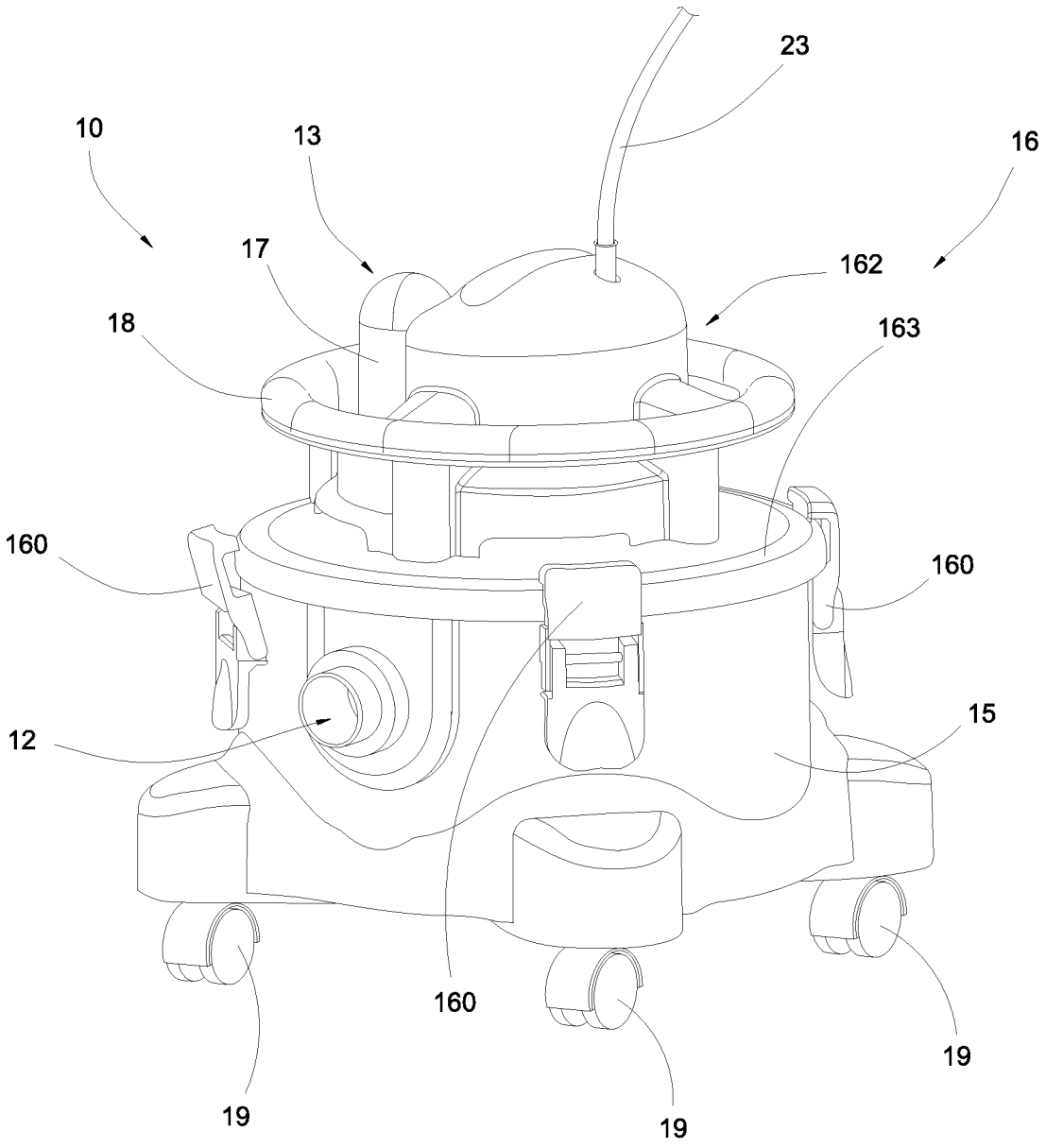
FIG. 2 is a perspective view of a portable housing of the in-water suction cleaner according to the above preferred embodiment of the present invention.
Figure 3:
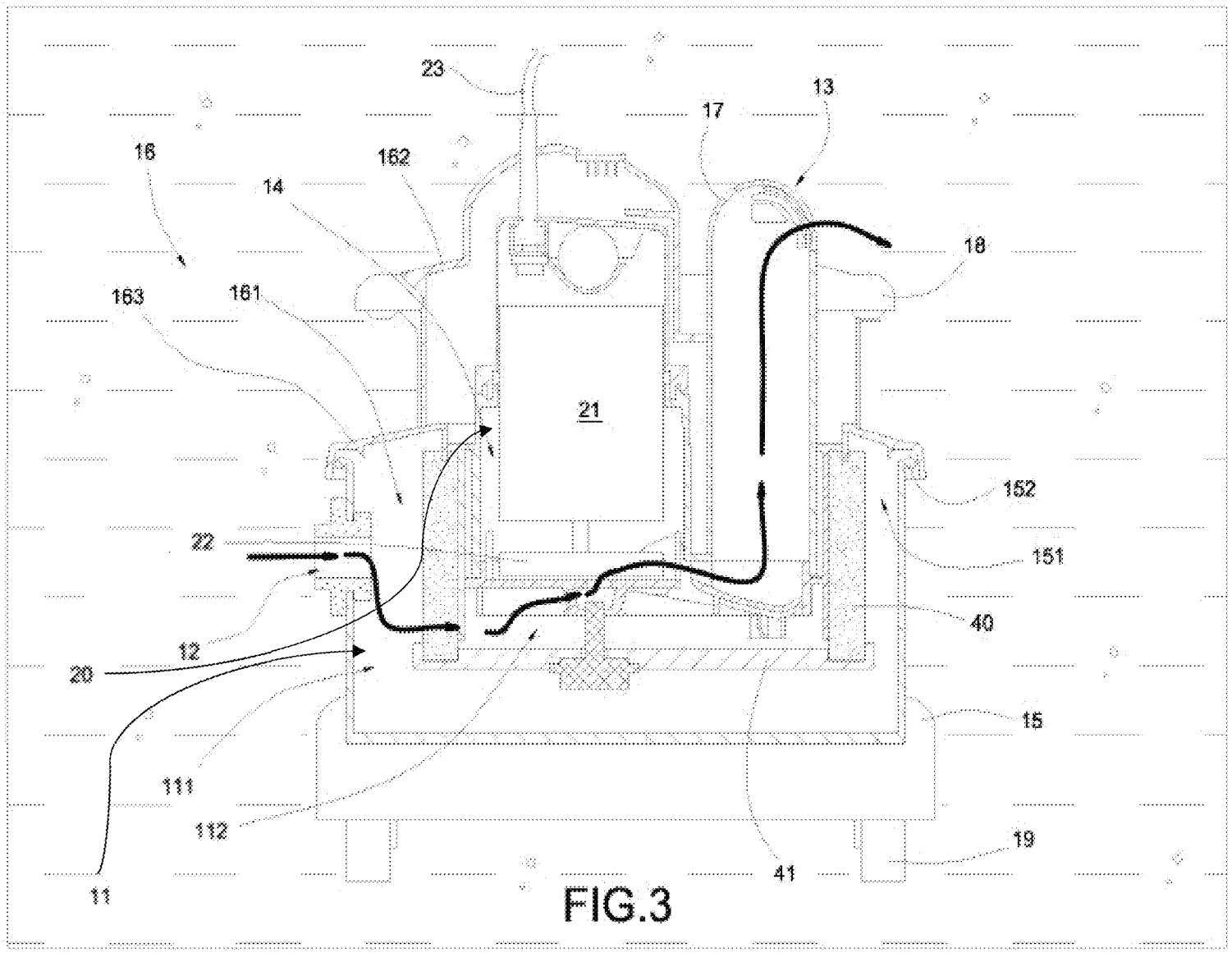
FIG. 3 is a sectional view of the portable housing of the in-water suction cleaner according to the above preferred embodiment of the present invention.

Referring to FIGS. 1 to 3 of the drawings, an in-water suction cleaner according to a preferred embodiment of the present invention is illustrated, wherein the in-water suction cleaner is adapted for cleaning a pool, tank and/or pond, and for scrubbing pool or tank surfaces. The in-water suction cleaner comprises a portable housing 10, a motorized unit 20, a manual scrubbing arrangement 30, and a filtering element 40.

According to the preferred embodiment, the portable housing 10 is adapted for disposing at the water during the operation of the in-water suction cleaner. The portable housing 10 has a suction cavity 11 for filling the water therein, a fluid inlet 12 for guiding the water to enter into the suction cavity 11, and a fluid outlet 13 for discharging the water from the suction cavity 11. Preferably, the fluid outlet 13 is located above the fluid inlet 12. In addition, the fluid inlet 12 is located below the water level when the portable housing 10 is disposed in the water.

The motorized unit 20 is supported in the portable housing 10, wherein the motorized unit 20 is operated for vacuuming the suction cavity 11 to suck the water in the suction cavity 11 out of the portable housing 10 through the fluid outlet 13 so as to create a suction at the fluid inlet 12.

The manual scrubbing arrangement 30 is detachably coupled at the fluid inlet 12 of the portable housing 10 for scrubbing the pool, tank, or pond surfaces and for sucking the water into the suction cavity 11 at the same time.

The filtering element 40 is replaceably disposed in the suction cavity 11 for filtering the water from the fluid inlet 12 to the fluid outlet 13 through the suction cavity 11, wherein after the water is filtered by the filtering element 40, the filtered water is discharged back to the pool or tank via the fluid outlet 13.

According to the preferred embodiment, the portable housing 10 comprises a base 15 and an operation body 16 housing the motorized unit 20 therein, wherein the operation body 16 is detachably coupled at the base 15, via a plurality of clipping elements 160, to define the suction cavity 11 within the base 15 and the operation body 16. In particular, the base 15 has a top opening 151 and a top opening rim 152, wherein a bottom portion 161 of the operation body 16 is received in the base 15 through the top opening 151 and is sealed at the top opening rim 152 of the base 15. The operation body 16 has a top portion 162 where the motorized unit 20 is housed therein and a supporting platform 163 formed between the bottom portion 161 and the top portion 162, wherein the supporting platform 163 is detachably and sealedly coupled at the top opening rim 152 to seal the suction cavity 11. The portable housing 10 further comprises a carrying rim 18 integrally formed at the operation body 16, where the user is able to carry the portable housing 10 via the carrying rim 18 and to pull the portable housing 10 out of the water via the carrying rim 18. A plurality of wheels 19 are provided at the bottom of the base 15. Accordingly, the top opening rim 152 of the base 15 must be located below the water level when the portable housing 10 is disposed in the water during operation to prevent any air leaked into the suction cavity 11 thereof In other words, the water must cover the supporting platform 163 to ensure the top opening rim 152 of the base 15 being located below the water level.

Figure 4:
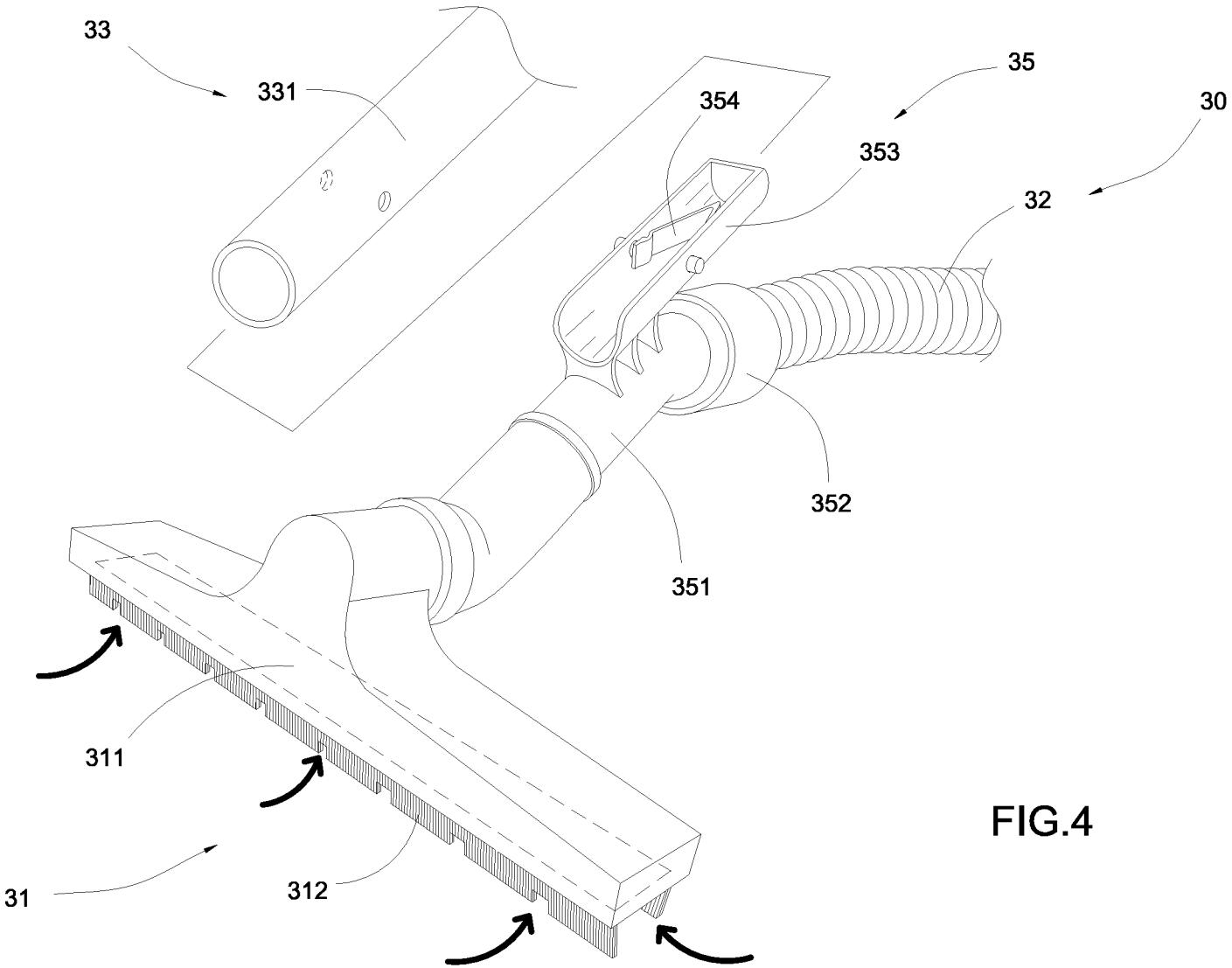
FIG. 4 is a perspective view of a coupling joint for connecting the suction tube, the scrubbing head, and the handle frame according to the above preferred embodiment of the present invention.

As shown in FIGS. 4, the fluid inlet 12 is provided at the base 15 while the fluid outlet 13 is provided at the operation body 16. In addition, the portable housing 10 further comprises a fluid chimney 17 extended upwardly from the suction cavity 11. The fluid chimney 17 is upwardly extended from the operation body 16, wherein the interior of the fluid chimney 17 communicates with the suction cavity 11. The fluid outlet 13 is formed at the top end of the fluid chimney 17, wherein an opening of the fluid outlet 13 faces sidewardly, such that the water is discharged sidewardly from the top end of the fluid chimney 17 through the fluid outlet 13. Therefore, the fluid outlet 13 is located below the water when the portable housing 10 is disposed at the water. It is worth mentioning that when portable housing 10 is used in shallow water, such as pond, only the fluid outlet 13 can be located above the water level while the rest of the portable housing 10 should be within the water.

The motorized unit 20, which is a waterproof motorized unit, comprises an electric motor 21 and an impeller 22 being driven to rotate by the electric motor 21, wherein the impeller 22 is located within the suction cavity 11 to create a pressure difference between the suction cavity 11 and an exterior of the portable housing 10. Therefore, the water within the suction cavity 11 will be sucked out to the fluid outlet 13 to create the suction at the fluid inlet 12 so as to prevent any suction loss thereof. It is worth mentioning that the electric motor 21 is supported at the top portion 162 of the operation body 16 while the impeller 22 is supported at the bottom portion 161 of the operation body 16. Accordingly, an electric cable 23 is upwardly extended from the electric motor 21 through the top side of the operation body 16. Preferably, the motorized unit 20 is submerged into the water that the motorized unit 20 is located below the water level during the operation.

As shown in FIG. 4, the portable housing 10 further has a motorized cavity 14 extended from the top portion 162 of the operation body 16 to the bottom portion 161 thereof, wherein the motorized unit 20 is supported at the motorized cavity 18 at a position that the electric motor 21 is located above the impeller 22. A bottom opening is formed at the motorized cavity 18 to communicate with the suction cavity 11.

According to the preferred embodiment, the manual scrubbing arrangement 30 comprises a scrubbing head 31, a flexible suction tube 32 extended between the scrubbing head 31 and the fluid inlet 12, and a handle frame 33 detachably coupled at the suction tube 32 to move the scrubbing head 31 scrubbing at the pool or tank surfaces.

Accordingly, the scrubbing head 31 comprises a scrubbing member 311 having an elongated scrubbing opening and an agitator 312 coupled at the scrubbing opening of the scrubbing member 311, wherein when the scrubbing member 311 is moved on the pool or tank surface, the agitator 312 will scrub the pool or tank surface and at the same time the water will be sucked into the fluid inlet 12 through the scrubbing opening of the scrubbing member 311.

The suction tube 32 is a flexible tube that can be freely bent and twisted to allow the free movement of the scrubbing head 31. Accordingly, the suction tube 32 has two ends that a first end of the suction tube 32 is communicatively connected to the fluid inlet 12 via a rotatable joint 34 and a second end of the suction 32 is communicatively connected to the scrubbing head 31 via a coupling joint 35.

The handle frame 33 comprises a length-adjustable handle 331 having one end detachably coupled to the scrubbing head 31 via the coupling joint 35, wherein when an opposed end of the length-adjustable handle 331 is held by the user, the scrubbing head 31 can be controllably moved to scrub the pool or tank surfaces.

As shown in FIG. 1, the rotatable joint 34 is rotatably coupled at the first end of the suction tube 32 to rotatably and detachably connect to the fluid inlet 12. Therefore, the user is able to rotatably couple the rotatable joint 34 at the fluid inlet 12 while the suction tube 32 is stationary in order to connect the suction tube 32 at the fluid inlet 12.

According to the preferred embodiment, the coupling joint 35 is a three-way connector to connect the scrubbing head 31, the suction tube 32, and the handle frame 33. In particular, the coupling joint 35, having a Y-shaped configuration, comprises an inserting connector 351 detachably inserted into a tubular socket of the scrubbing head 31, a tube connector 352 coupled at the second end of the suction tube 32, and a spring-loaded connector 353 detachably coupled at one end of the length-adjustable handle 331 of the handle frame 33, as shown in FIG. 4. The inserting connector 351 is arranged to detachably insert into the tubular socket of the scrubbing member 311 of the scrubbing head 31 in a rotatably movable manner. The tube connector 352 is provided at the second end of the suction tube 32 in a rotatable manner. The spring-loaded connector 353 comprises a spring locker 354 having two biasing ends, wherein when the spring-loaded connector 353 is slidably inserted into the length-adjustable handle 331, the biasing ends of the spring locker 354 are pushed outwardly to engage with two locking slots at the length-adjustable handle 331 respectively. When the biasing ends of the spring locker 354 are pushed inwardly to disengage with two locking slots, the length-adjustable handle 331 can be slid out of the spring-loaded connector 353 so as to detach the length-adjustable handle 331 from the coupling joint 35.

The filtering element 40 is detachably coupled at the portable housing 10 at a position that the bottom portion 161 of the operation body 16 is encircled by the filtering element 40, wherein a filtering panel 41 is detachably coupled at a bottom of the operation body 16 to retain the filtering element 40 around the bottom portion 161 of the operation body 16. In other words, the filtering element 40 has a circular shape for detachably encircling around the bottom portion 161 of the operation body 16. Accordingly, the filtering element 40 is replaceable and washable for filtering different fluids with debris and dirt according to the pools, tanks or ponds. For example, when the in-water suction cleaner of the present invention is arranged to filter the water from the swimming pool, the filtering element 40 as a high permeable filter is used. When the in-water suction cleaner of the present invention is arranged to filter the water from the pond, the filtering element 40 as a low permeable filter must be used. It is because the filtering element 40 needs to filter sands and silts from the water in the pond.

According to the preferred embodiment, the filtering element 40 is disposed in the suction cavity 11 to partition the suction cavity 11 into an unfiltered cavity 111 communicating with the fluid inlet 12 and a filtered cavity 112 communicating with the fluid outlet 13. In particular, the filtering element 40 is coupled at the bottom portion 161 of the operation body 16 to form the filtered cavity 112 thereat so as to communicate with the unfiltered cavity 111 when the operation body 16 is detachably coupled at the base 15. It is worth mentioning that the water is initially sucked into the unfiltered cavity 111 and is then entered to the filtered cavity 112 after passing through the filtering element 40. The water is then discharged back to the pool or tank via the fluid outlet 13 from the filtered cavity 112.

In addition, the motorized unit 20 will create the suction at the filtered cavity 112 by creating a negative pressure thereat to suck the water in the unfiltered cavity 111, such that the suction power of the motorized unit 20 can be easily controlled to ensure the motorized unit 20 providing enough suction power to suck the water from the unfiltered cavity 111 to the filtered cavity 112. In other words, the volume of water entering to the filtered cavity 112 from the unfiltered cavity 111 should be the same as the volume of water entering to the unfiltered cavity 111 from the fluid inlet 12, and should be the same as the volume of water discharging back to the pool or tank via the fluid outlet 13 from the filtered cavity 112.

As shown in FIG. 3, the fluid inlet 12 is provided at an upper portion of the base 15, wherein the unfiltered cavity 111 is formed at the bottom portion of the base 15. Therefore, when the water enters into the unfiltered cavity 111 from the fluid inlet 12, debris and dirt will be initially deposited and precipitated at the bottom of the unfiltered cavity 111 before the water is filtered. In other words, the debris and dirt will sink at the bottom of the suction cavity 11 before the water is filtered. In addition, the direction of water passing from the unfiltered cavity 111 to the filtered cavity 112 is the radial direction of the filtering element 40. As a result, the debris and dirt being sunk at the bottom of the suction cavity 11 will be blocked by the filtering panel 41 and will not be sucked to the filtered cavity 112, so as to enhance the filtering efficiency of the filtering element 40.

Accordingly, the present invention further comprises a method of operating the in-water suction cleaner for cleaning a pool or tank, comprising the following steps.

(A) Fill the water into the suction cavity 11 of the portable housing 10 via the fluid inlet thereof by submerging the portable housing 10 into the pool or tank. Alternatively, the user is able to fill up the suction cavity 11 of the portable housing 10 by tape water.

(B) Detachably couple the manual scrubbing arrangement 30 at the fluid inlet 12 of the portable housing 10. In particular, the manual scrubbing arrangement 20 is setup by the steps of: coupling the suction tube 32 with the scrubbing head 32 and a handle frame 33 via the coupling joint 35; filling the suction tube 32 with the water; and coupling the suction tube 32 with the fluid inlet 12 of the portable housing 10 via the rotatable joint 34. It is worth mentioning that the suction tube 32 should be filled with water, such as by submerging the suction tube 32 into the pool or tank, to ensure no air being stayed in the suction tube 32, such that when the motorized unit 20 is operated, the water in the suction tube 32 will be initially sucked into the suction cavity 11 to prevent any air being sucked thereinto. It is worth mentioning that the top opening rim 152 of the base 15 must be located below the water level when the portable housing 10 is disposed in the water during operation to prevent any air leaked into the suction cavity 11 thereof.

(C) Power on the motorized unit 20 for vacuuming the suction cavity 11 to suck the water in the suction cavity 11 out of the portable housing 10 through the fluid outlet 13 thereof so as to create the suction at the fluid inlet 12. Accordingly, the electric cable should not be connected to a power source before the suction cavity 11 of the portable housing 10 is filled with water and the setup of the manual scrubbing arrangement 30. In other words, the portable housing 10 is disposed at the water before the motorized unit 20 is powered on. Once the electric cable is connected to the power source, the motorized unit 20 is powered on to suck the water into the suction cavity 11.

It is worth mentioning that since the portable housing 10 is disposed at the water, the portable housing 10 is dragged at the water when the user holds the length-adjustable handle 331 to move the scrubbing head 31. In other words, the movement of the portable housing 10 at the water will correspond to the movement of the user so as to enhance the portability of the in-water suction cleaner during the operation.

(D) Filter the water from the fluid inlet 12 to the fluid outlet 13 through the suction cavity 11 via the filtering element 40 replaceably disposed in the suction cavity 11. It is worth mentioning that a corrected filtering element 40 should be mounted in portable housing 10 before it is used. For example, the user is able to detach the operation body 16 from the base 15, wherein the filtering panel 41 can be detached from the bottom of the operation body 16, such that the filtering element 40 can be mounted at the bottom portion 161 of the operation body 16 and the filtering panel 41 can be re-attached to the bottom of the operation body 16 to retain the filtering element 40 in position. Then, the operation body 16 can be coupled to the base 15.

(E) Discharge the water back to the pool or tank via the fluid outlet 13 after the water is filtered. Accordingly, after filtering the water, the filtered water will fill in the fluid chimney 17 and will be discharged out of the fluid chimney 17 via the fluid outlet 13. It is worth mentioning that the fluid outlet 13 is located below the water when the portable housing 10 is disposed at the water.

Once the cleaning process is completed, the user is able to power off the motorized unit 20 by unplugging the electric cable from the power source. Then, portable housing 10 can be taken out from the pool or tank. The debris and dirt will be collected at the unfiltered cavity 111. The filtering element 40 can be removed from the portable housing 10, rinsed by clean water, and dried for next time usage.

According to the preferred embodiment, the water flowing direction is that the unfiltered water from the pool or tank is initially flowed into the water inlet 12 from the scrubbing head 31 through the suction tube 32. Then, the unfiltered water will enter into the unfiltered cavity 111. The unfiltered water in the unfiltered cavity 111 will suck into the filtered cavity 112 by passing through the filtering element 40 via the suction of the motorized unit 20. In other words, the unfiltered water will become filtered water in the filtered cavity 112. The filtered water will enter into the fluid chimney 17 and will be discharged out of the fluid chimney 17 via the fluid outlet 13 back to the pool or tank.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. An in-water suction cleaner for cleaning one or more surfaces of a pool or tank, comprising:

a portable housing for disposing in water of the pool or tank, wherein said portable housing has a suction cavity for filling the water therein, a fluid inlet for guiding the water to enter into said suction cavity, and a fluid outlet for discharging the water from said suction cavity;

a motorized unit supported in said portable housing for vacuuming said suction cavity to suck the water in said suction cavity out of said portable housing through said fluid outlet so as to create a suction at said fluid inlet;

a manual scrubbing arrangement detachably coupled at said fluid inlet of said portable housing for scrubbing the surfaces of the pool or tank and for sucking the water into said suction cavity at the same time, wherein said manual scrubbing arrangement comprises a scrubbing head, a flexible suction tube extended between said scrubbing head and said fluid inlet, and a handle frame detachably coupled at said suction tube to move said scrubbing head scrubbing at the surfaces of the pool or tank; and a filtering element replaceably disposed in said suction cavity for filtering the water from said fluid inlet to said fluid outlet through said suction cavity so as to ensure the water after filtered being discharged back to the pool or tank via said fluid outlet.

2. The in-water suction cleaner, as recited in claim 1, wherein said manual scrubbing arrangement further comprises a rotatable joint rotatably coupled at a first end of said suction tube to rotatably couple at said fluid inlet, and a coupling joint coupled at an opposed second end of said suction tube to detachably couple at said scrubbing head.

3. The in-water suction cleaner, as recited in claim 2, wherein said coupling joint, which is a three-way connector, comprises an inserting connector detachably inserted into a tubular socket of said scrubbing head, a tube connector coupled at said second end of said suction tube, and a spring-loaded connector detachably coupled at one end of said handle frame.

4. An in-water suction cleaner for cleaning one or more surfaces of a pool or tank, comprising:

a portable housing for disposing in water of the pool or tank, wherein said portable housing has a suction cavity for filling the water therein, a fluid inlet for guiding the water to enter into said suction cavity, and a fluid outlet located above said fluid inlet for discharging the water from said suction cavity;

a motorized unit supported in said portable housing for vacuuming said suction cavity to suck the water in said suction cavity out of said portable housing through said fluid outlet so as to create a suction at said fluid inlet;

a manual scrubbing arrangement detachably coupled at said fluid inlet of said portable housing for scrubbing the surfaces of the pool or tank and for sucking the water into said suction cavity at the same time, wherein said manual scrubbing arrangement comprises a scrubbing head, a flexible suction tube extended between said scrubbing head and said fluid inlet, and a handle frame detachably coupled at said suction tube to move said scrubbing head scrubbing at the surfaces of the pool or tank; and a filtering element replaceably disposed in said suction cavity for filtering the water from said fluid inlet to said fluid outlet through said suction cavity so as to ensure the water after filtered being discharged back to the pool or tank via said fluid outlet.

5. The in-water suction cleaner, as recited in claim 4, wherein said manual scrubbing arrangement further comprises a rotatable joint rotatably coupled at a first end of said suction tube to rotatably couple at said fluid inlet, and a coupling joint coupled at an opposed second end of said suction tube to detachably couple at said scrubbing head.

6. The in-water suction cleaner, as recited in claim 5, wherein said coupling joint, which is a three-way connector, comprises an inserting connector detachably inserted into a tubular socket of said scrubbing head, a tube connector coupled at said second end of said suction tube, and a spring-loaded connector detachably coupled at one end of said handle frame.

7. The in-water suction cleaner, as recited in claim 4, wherein said filtering element is disposed in said suction cavity to partition said suction cavity into an unfiltered cavity communicating with said fluid inlet and a filtered cavity communicating with said fluid outlet, such that after the water is filtered to pass from said unfiltered cavity to said filtered cavity, the water is discharged back to the pool or tank via said fluid outlet.

8. The in-water suction cleaner, as recited in claim 7, wherein said portable housing comprises a base defining said unfiltered cavity therein and an operation body housing said motorized unit therein, wherein said filtering element is coupled at a bottom portion of said operation body to form said filtered cavity thereat so as to communicate with said unfiltered cavity when said operation body is detachably coupled at said base, wherein said base has a top opening rim that said operation body is detachably coupled to said base at said top opening rim thereof, wherein said top opening rim of said base is located below a water level when said portable housing is disposed at the water.

9. The in-water suction cleaner, as recited in claim 8, wherein said filtering element has a circular shape detachably encircling around said bottom portion of said operation body.

10. The in-water suction cleaner, as recited in claim 4, wherein said motorized unit comprises an electric motor and an impeller being driven to rotate by said electric motor within said suction cavity so as to create a pressure difference between said suction cavity and an exterior of said portable housing.

11. The in-water suction cleaner, as recited in claim 9, wherein said motorized unit comprises an electric motor and an impeller being driven to rotate by said electric motor within said suction cavity so as to create a pressure difference between said suction cavity and an exterior of said portable housing.

12. A method of operating an in-water suction cleaner for cleaning a pool or tank , comprising the steps of:

(a) filling water into a suction cavity of a portable housing via a fluid inlet thereof;

(b) detachably coupling a manual scrubbing arrangement at said fluid inlet of said portable housing, comprising the steps of:

(b.1) coupling a flexible suction tube of said manual scrubbing arrangement with a scrubbing head and a handle frame;

(b.2) filling said suction tube with the water; and (b.3) coupling said suction tube with said fluid inlet of said portable housing;

(c) powering on a motorized unit, which is supported in said portable housing, for vacuuming said suction cavity to suck the water in said suction cavity out of said portable housing through a fluid outlet thereof so as to create a suction at said fluid inlet, wherein said motorized unit is powered on when said portable housing is disposed in the water;

(d) filtering the water from said fluid inlet to said fluid outlet through said suction cavity via a filtering element replaceably disposed in said suction cavity; and (e) discharging the water back to the pool or tank via said fluid outlet after the water is filtered.

13. The method, as recited in claim 12, wherein, in the step (b.1), one end of said suction tube is rotatably coupled at said fluid inlet via a rotatable joint and another end of said suction tube is detachably coupled at said scrubbing head via a coupling joint, wherein said coupling joint, which is a three-way connector, comprises a tube connector coupled at said second end of said suction tube, an inserting connector detachably inserted into a tubular socket of said scrubbing head, and a spring-loaded connector detachably coupled at one end of said handle frame.

* * * * *